US009360020B2

(12) United States Patent
Janecek

(10) Patent No.: US 9,360,020 B2
(45) Date of Patent: Jun. 7, 2016

(54) SELF-COOLING FAN ASSEMBLY

(71) Applicant: Electric Torque Machines, Inc., Flagstaff, AZ (US)

(72) Inventor: Thomas F. Janecek, Flagstaff, AZ (US)

(73) Assignee: Electric Torque Machines Inc, Flagstaff, AZ (US)

( * ) Notice: Subject to any disclaimer, the term of this patent is extended or adjusted under 35 U.S.C. 154(b) by 1 day.

(21) Appl. No.: 14/259,959

(22) Filed: Apr. 23, 2014

(65) Prior Publication Data

US 2015/0308438 A1 Oct. 29, 2015

(51) Int. Cl.

| | |
|---|---|
| ***F04D 25/08*** | (2006.01) |
| ***F01D 5/14*** | (2006.01) |
| ***F01D 5/18*** | (2006.01) |
| ***F04D 29/38*** | (2006.01) |
| *F04D 29/58* | (2006.01) |

(52) U.S. Cl.

CPC ..... *F04D 25/082* (2013.01); *F01D 5/147* (2013.01); *F01D 5/18* (2013.01); *F04D 25/088* (2013.01); *F04D 29/388* (2013.01); *F04D 29/5813* (2013.01); *F05D 2240/307* (2013.01); *F05D 2260/601* (2013.01)

(58) Field of Classification Search

CPC ... F04D 25/088; F04D 25/082; F04D 29/388; F01D 5/147

USPC ..... 416/90 R, 91, 232

See application file for complete search history.

(56) References Cited

U.S. PATENT DOCUMENTS

| | | | | |
|---|---|---|---|---|
| 2,553,078 | A * | 5/1951 | Buck | F01D 5/087 415/115 |
| 3,736,797 | A | 6/1973 | Brown | |
| 4,452,566 | A * | 6/1984 | Kardas | F04D 29/584 415/115 |
| 5,016,837 | A | 5/1991 | Willis | |
| 5,029,451 | A | 7/1991 | Imaiida et al. | |
| 5,114,309 | A * | 5/1992 | Hengelmolen | F04D 29/30 415/112 |
| 5,340,278 | A | 8/1994 | Magowan | |

(Continued)

FOREIGN PATENT DOCUMENTS

| | | |
|---|---|---|
| GB | 760731 | 11/1956 |
| GB | 933222 | 8/1963 |

(Continued)

OTHER PUBLICATIONS

PCT Application PCT/US2014/035173, International Search Report and Written Opinion, Apr. 23, 2014, 9 pages.

*Primary Examiner* — Peter J Bertheaud

*Assistant Examiner* — Dominick L Plakkoottam

(74) *Attorney, Agent, or Firm* — Invention To Patent Services; Alex Hobson

(57) ABSTRACT

A self-cooling fan in configured with a vent feature that draws air into a fan housing and over a heat sink to dissipate heat generated by the motor and/or control unit. The self-cooling fan has a conduit with an attached end opening that couples with a cooling zone within the fan housing and extends along a portion of the fan blade(s). A vent feature is an opening in a conduit, at or near the extended end of the conduit, that allows air to exit the conduit. A vent feature may be a venturi feature. A venturi feature creates a vacuum within a conduit via outer diameter blade velocities interacting with venturi geometries when the blades are rotating, further promoting the drawing of air into the fan housing. A cooling channel allows air from outside of the fan assembly to enter into a cooling zone where a heat sink is configured.

23 Claims, 15 Drawing Sheets

(56) References Cited

U.S. PATENT DOCUMENTS 5,462,407 A * 10/1995 Calvo ..... F04D 29/382 415/205
5,927,944 A 7/1999 Belady
5,967,764 A * 10/1999 Booth ..... H02K 9/06 416/169 A
6,125,920 A 10/2000 Herbert
6,219,242 B1 * 4/2001 Martinez ..... H05K 7/20154 165/121
6,852,025 B2 2/2005 Gumucio Del Pozo
6,939,108 B2 * 9/2005 Boyd ..... F01D 5/147 416/210 R
6,948,906 B2 9/2005 Leishman et al.
7,422,163 B1 * 9/2008 DeVorss ..... F04D 25/088 239/209
7,637,715 B2 * 12/2009 Battisti ..... F03D 11/0025 290/55
8,066,480 B2 * 11/2011 Madsen ..... F04D 25/088 310/92
8,231,330 B1 7/2012 Liang
8,491,263 B1 7/2013 Liang
2002/0001521 A1 1/2002 Boyd et al.
2007/0152528 A1 7/2007 Kang et al.
2007/0155304 A1 * 7/2007 Hyun ..... F04D 25/088 454/338
2009/0116980 A1 5/2009 Monjes et al.
2011/0176920 A1 7/2011 Zhang
2012/0012669 A1 * 1/2012 McBride ..... A61L 9/122 239/34
2012/0128501 A1 * 5/2012 Hoofard ..... F03D 1/001 416/241 R
2015/0147188 A1 * 5/2015 Danielsson ..... F04D 25/0613 417/14

FOREIGN PATENT DOCUMENTS

GB 933222 A * 8/1963 ..... B63B 39/06
GB 2166806 5/1986

* cited by examiner

SELF-COOLING FAN ASSEMBLY

BACKGROUND

1. Technical Field

The disclosed technology relates to a self-cooling fan assembly.

2. Background

Fans and specifically cooling fans, such as ceiling fans, comprise motors, and in some cases control units, that produce heat. This heat must be dissipated to ensure the proper and long-term function of the fan assembly. In particular, high volume low speed (HVLS) fans run at low speeds and utilize rather large motors that produce a considerable amount of heat. There is a need for a low cost and effective means to dissipate the heat produced by fan assemblies.

SUMMARY OF THE INVENTION

The invention is directed to a self-cooling fan comprising a vent feature that draws air into a fan housing and over a heat sink to dissipate heat generated by the motor and/or control unit. The self-cooling fan comprises a conduit having an attached end opening that couples with a cooling zone within the fan housing and extends along a portion of the fan blade(s). A vent feature is an opening in a conduit, at or near the extended end of the conduit, that allows air to exit the conduit. In an exemplary embodiment, when the fan blades rotate, air is drawn through a cooling channel and into the cooling zone via the centrifugal force of the air in the conduit where it passes over a heat sink before flowing along the conduit and out of the vent feature. A vent feature may be an opening in a conduit and may comprise a venturi feature. A venturi feature, as described herein, creates a vacuum within a conduit via outer diameter blade velocities interacting with venturi geometries when the blades are rotating, further promoting the drawing of air into the fan housing. A cooling channel allows air from outside of the fan assembly to enter into a cooling zone where a heat sink is configured. A cooling channel may extend from the cooling zone to the area just outside of the fan housing, or within the room, or other area, in which the fan is mounted. In an exemplary embodiment, the cooling zone is substantially sealed except for air introduction through the cooling channel or channels. In the cooling zone, air flows over and/or through a heat sink and then into an attached end opening of a conduit, along the conduit and out of the vent feature. In one embodiment, the conduit is an opening within the fan blades and a venturi feature is configured at the extended end of the fan blades.

A vent feature may comprise one or more openings in or near the extended end of a conduit. Air may be forced out of the vent feature by centrifugal force and thereby draw air into the fan housing. In an exemplary embodiment, a vent feature is configured at the extended end of the fan blades. A conduit may be configured within a fan blade and terminate in a vent feature at the extended end of the fan blade. A fan blade may be hollow for example. A vent feature may be a venturi feature that is configured to create a vacuum when the fan blades are rotating. A venturi feature may be an opening in a conduit configured in such a way to create a vacuum or may comprise a venturi adapter that is configured to increase the vacuum created in the conduit.

A venturi feature may be an integral venturi feature and comprise a specific extended fan blade end geometry and venturi opening configuration. For example, a fan blade may have one or more holes formed in the extended end of the fan blade to produce a venturi effect and create a flow of air through a hollow portion of the fan blade. In another embodiment, a venturi adapter is a separate component that is attached to a conduit, such as the extended end of hollow fan blade. A venturi adapter may be configured at the extended end of a fan blade or on the top, bottom, leading or trailing edge of a fan blade. For example, a venturi adapter may comprise a geometric feature that enhances the vacuum formed in an opening configured along the top surface of a fan blade. A venturi adapter may comprise venturi openings that are substantially tangential with the rotational direction of the fan blade. A venturi may comprise a channel, whereby air is captured in the channel and a change in cross-sectional area of the cannel over the length creates a venturi effect. A venturi feature may be configured at or near the extended end of the conduit. In one embodiment, a venturi feature comprises an opening along the top and/or bottom of the fan blade in a position configured to create a vacuum when the blades are rotating. A venturi feature may be configured in one or more of the fan blades and is preferably configured in all of the fan blades.

A venturi feature may be a direction neutral venturi feature, whereby the venturi feature will create a vacuum and draw air out of the fan blade when the fan blade is rotating in either direction. For example, holes in the extended end of a fan blade may be an effective direction neutral venturi feature.

A self-cooling fan assembly, as described herein, may be any suitable type of fan used for cooling, including box fans, ceiling fans and the like. A self-cooling fan may be an HVLS fan that comprises relatively long fan blades. An HVLS fan generally has a diameter in excess of 7 feet and may have a diameter in excess of 10 feet, 15 feet or 20 feet. An HVLS fan may be configured to rotate at relatively low speeds between 50 rpm and generally no more than 100 revolutions per minute (rpm).

A self-cooling fan, as described herein may comprise any suitable number of components including a motor and a control unit. Any suitable type of motor may be used in a self-cooling fan, as described herein, including a conventional wound electric motor and a transverse flux motor. A transverse flux motor, such as those described in U.S. Pat. No. 6,664,704, U.S. Pat. No. 6,924,579, U.S. Pat. No. 7,876,019, U.S. Pat. No. 7,800,275, U.S. Pat. Nos. 7,863,797, 7,868,511, 7,973,446, U.S. Pat. No. 7,989,084 to Mr. Calley, et al., all of which are incorporated by reference herein.

A self-cooling fan assembly may comprise a motor and or housing in any suitable configuration. For example, the rotor of a motor may be configured to spin a centrally located shaft and the fan blades may be attached to the shaft. In another embodiment, the rotor may be attached to a blade mount which is configured to rotate about a center shaft. A motor may be configured below or above the fan blades. A control unit may be configured within a motor cover or the motor and control unit may be contained within a single fan housing. In another embodiment, a control unit is a separate unit that may be configured above or below the motor. In an exemplary embodiment, a motor is configured above the fan blades and the control unit is configured below the fan blades. In this embodiment, a cooling zone is configured between the motor and the control unit.

A heat sink, as described herein, may be any suitable type of heat sink and may comprise a plurality of fins. Airflow in the cooling zone may flow over and/or through the heat sink. In an exemplary embodiment, a heat sink comprises a plurality of fins that extend radially from a centerline of the fan assembly, or a line extending along the length of a mounting shaft, in most cases. In this embodiment, air flows through a cooling channel, through the fins and then along the fins to the an opening in the attached end of the fan blades. A heat sink may be at least partially configured within a cooling channel. A cooling channel is an open area configured to allow airflow into the cooling zone. In an exemplary embodiment, a cooling channel is an area between the central shaft and either a motor or a control unit. A heat sink may comprise metal, or any other suitable heat conductive material.

A fan blade, as described herein, comprises a conduit that extends along a portion of the length of the fan blade, from an opening at the attached end to an opening at or near the extended end. In an exemplary embodiment, a conduit extends a substantial portion of the length of the fan blade, such as more than about 50 percent of the length of the fan blade, more than about 75 percent of the length of the fan blade, more than about 90 percent of the length of the fan blade, and any range between and including the values provided. In an exemplary embodiment, a fan blade is hollow and the open area within the fan blade is the conduit for airflow. A hollow fan blade may have a conduit opening at the extended end of the fan blade, such as in the end of the fan blade or along the perimeter of the fan blade proximate the extended end, such as in the top surface of the fan blade. In another embodiment, a fan blade has a conduit configured within the fan blade. In still another embodiment, a conduit is attached to or is configured on the exterior of the fan blade. A conduit may be a single conduit or may comprise a plurality of discrete conduits.

The self-cooling fan assembly, as described, provides a method of cooling a motor and/or control unit of a fan when the fan blades are rotating. A self-cooling fan, as described in any of the embodiments herein, cools the fan-assembly utilizing a vent feature. Air flows out of the extended end of the a conduit, through a cooling zone where air flows over a heat sink. The heat sink is coupled to a motor and/or control unit to dissipate heat. Air is introduced into the cooling zone from a cooling channel that is direct fluid communication with the airspace around the fan, as described herein.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
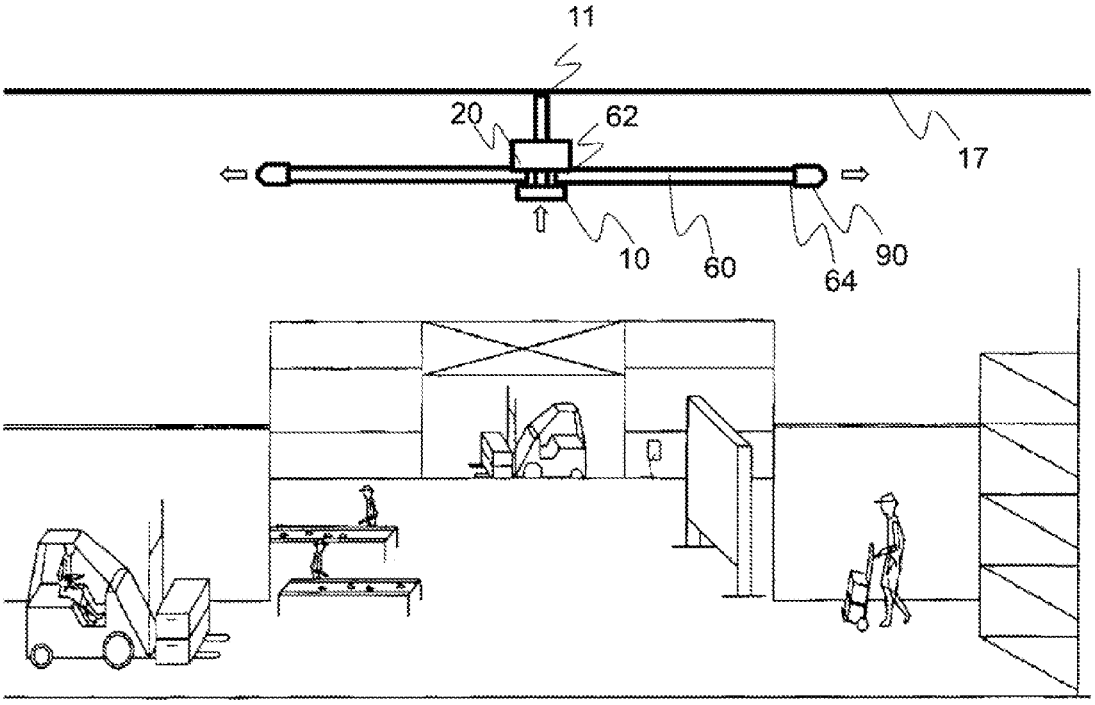
FIG. 1 shows an exemplary self-cooling fan assembly mounted to the ceiling of a warehouse.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1, an exemplary self-cooling fan assembly 10 is mounted to the ceiling 17 of a warehouse. The fan shown in FIG. 1 is a high volume low speed (HVLS) fan, having a fan blade span of at least 7 feet in diameter. These types of fans are used to provide a high volume of air movement at relatively low revolutions per minute (rpm), such as no more than about 100 rpm, no more than 75 rpm, no more than 50 rpm and any range between and including the speeds provided. The fan blades 60 have a venturi feature 90 configured at the extended end 64. A conduit extending between the attached end 62 and the extended end 64 of the fan blade allows draws air up into the fan housing 20 to cool components of the fan assembly.

Figure 2:
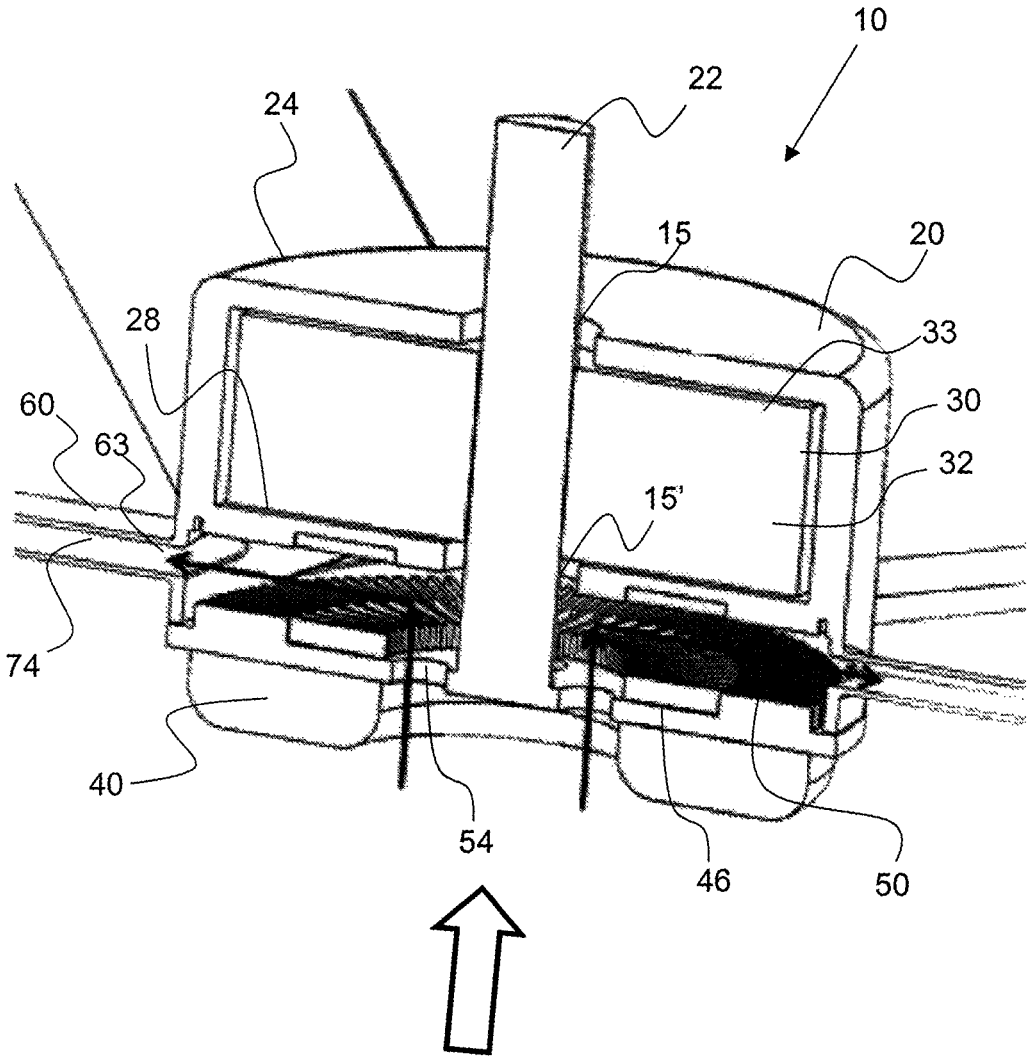
FIG. 2 shows an isometric cross-sectional view of an exemplary self-cooling fan assembly having a cooling channel configured between a shaft and a control unit.

As shown in FIG. 2, an exemplary self-cooling fan assembly 10 has a cooling channel 54 configured between a shaft 22 and a control unit 40. Air, as indicated by the arrows, is drawn up into the cooling channel and across a heat sink 50 before entering a conduit 74 configured along the fan blades 60. The fan blades have an attached end opening 63 to allow air to enter the conduit within the fan blade. A vent feature (not show), at the extended end of the blades allows centrifugal airflow within conduit 74 creating suction that continually draws air into the fan housing 20 when the fan blades are rotating. The control unit is attached to a control unit mount 46 having an opening to form a cooling channel 54 between the shaft and the control unit. A heat sink 50 may act as a control unit mount or may be attached thereto. A motor 30, having a stator 33 attached to the shaft 22 and a rotor attached to the motor cover 24 is configured above the control unit. In this embodiment, the shaft does not spin, rather, the motor cover and the fan blades 60 attached to a blade mount 28 rotate about the shaft. The control unit 40 is attached to the shaft and does not rotate with the blades.

Figure 3:
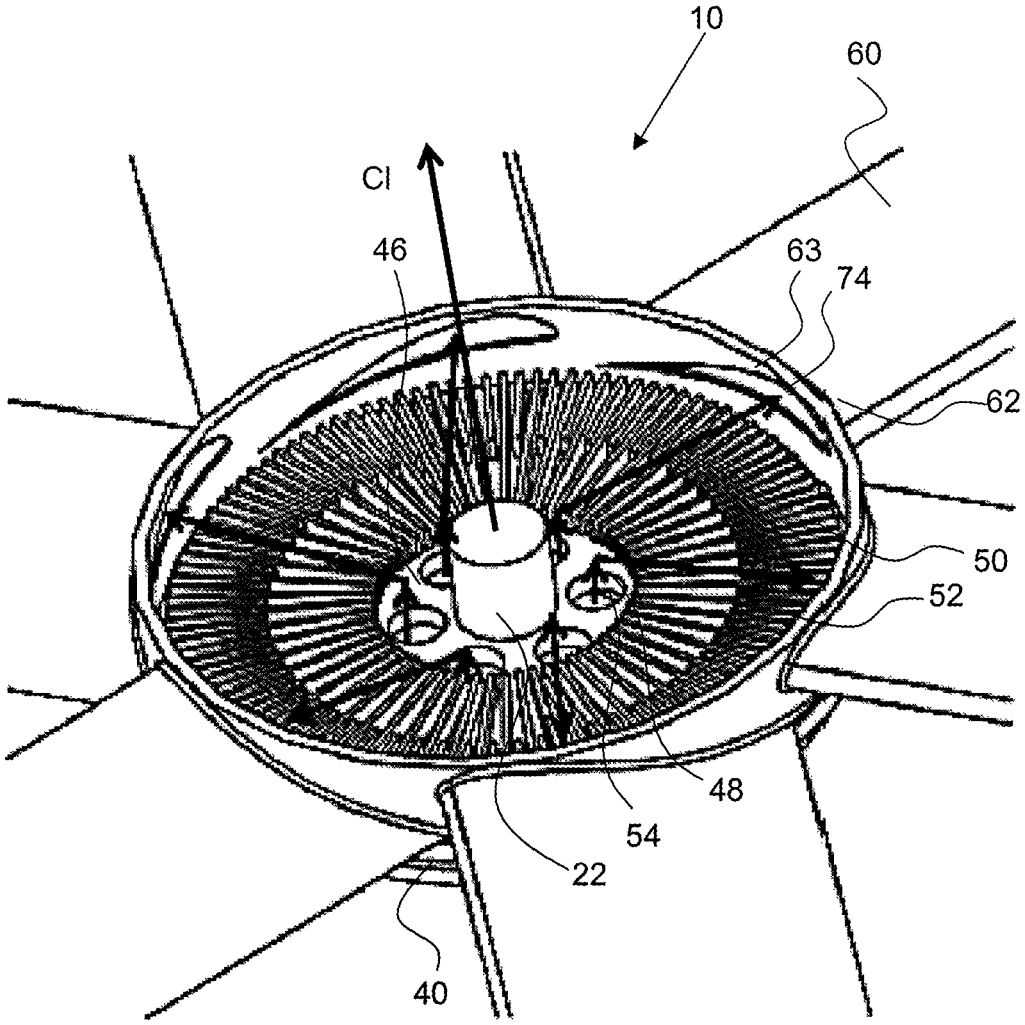
FIG. 3 shows an isometric view of an exemplary fan housing interior having a heat sink coupled to a control unit and configured within the path of airflow through the cooling zone.

As shown in FIG. 3, an exemplary self-cooling fan assembly 10 has a heat sink 50 coupled to a control unit 40 and configured within an airflow. The heat sink comprises a plurality of fins 52 that extend radially from the centerline Cl of the fan assembly. The airflow, as indicated by the dark arrows, comes up through a plurality of cooling channels in the control unit mount 46, across the fins, into the attached end opening 63 and along the conduit 74 within the fan blade 60.

Figure 4:
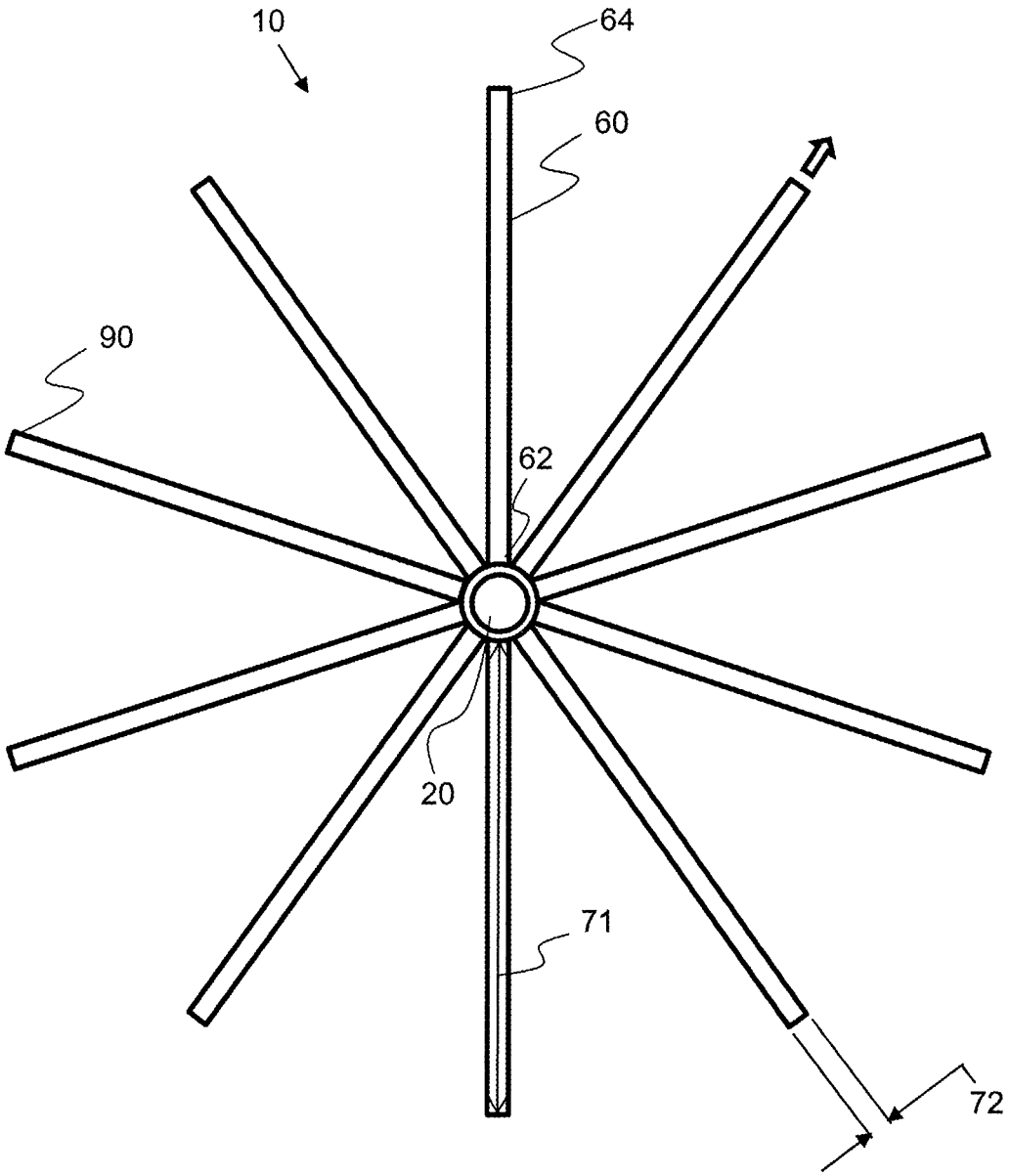
FIG. 4 shows a bottom-up view of an exemplary self-cooling fan assembly having a plurality of fan blades coupled to a fan housing and comprising a vent feature at the extended end.

As shown in FIG. 4, an exemplary self-cooling fan assembly 10 has a plurality of fan blades 60 coupled to a fan housing 20 and the extended end 64 of each fan blade comprises a venturi feature 90. The venturi feature draws air out from a conduit that extends from the attached ends 62 to the extended ends 64 of the fan blades. The length 71 and width 72 of the fan blades 60 is shown in FIG. 4. A venturi feature may be configured in any location along the length of the fan blades, however the velocity and venturi effect, amount of vacuum created, may be most effective at the end of the fan blades.

Figure 5:
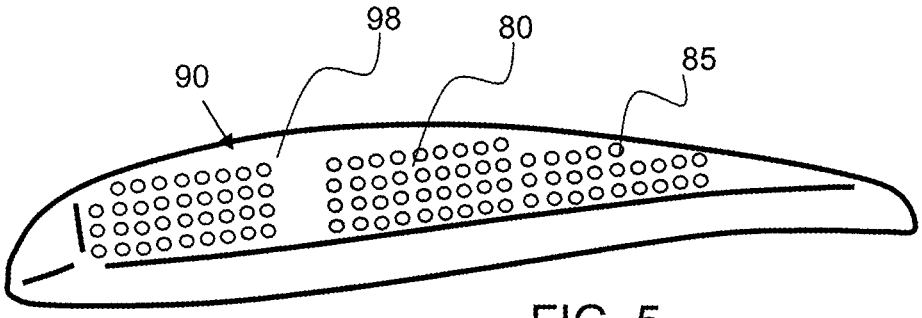
FIG. 5 shows a side view of an exemplary vent feature adapter comprising a plurality of openings.

As shown in FIG. 5, an exemplary venturi feature 90 comprises a plurality of venturi openings 98. Any suitable shape, size and number of openings may be configured in a venturi feature to produce a venturi effect and draw air out from a conduit configured along a fan blade. The venturi feature shown in FIG. 5 is configured to be attached to the extended end of a fan blade, however, a fan blade may comprise an integral venturi feature, wherein at least one opening is configured in the extended end of the fan blade to produce a venturi effect when the fan blade rotates.

Figure 6:
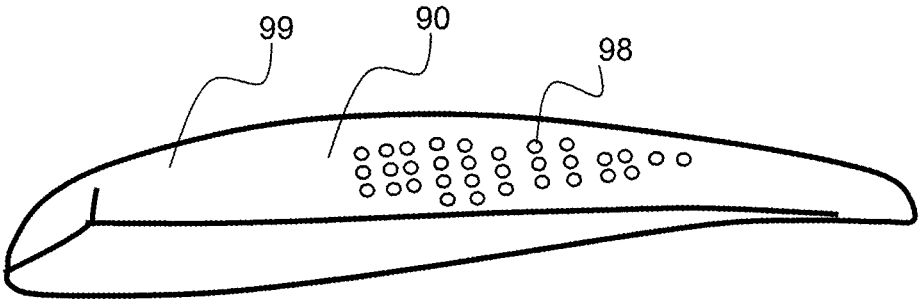
FIG. 6 shows a side view of an exemplary venturi feature adapter comprising a plurality of openings.

As shown in FIG. 6, an exemplary venturi feature 90 comprises a plurality of venturi openings 98. Any suitable number of venturi openings may be configured in a venturi feature.

Figure 7:
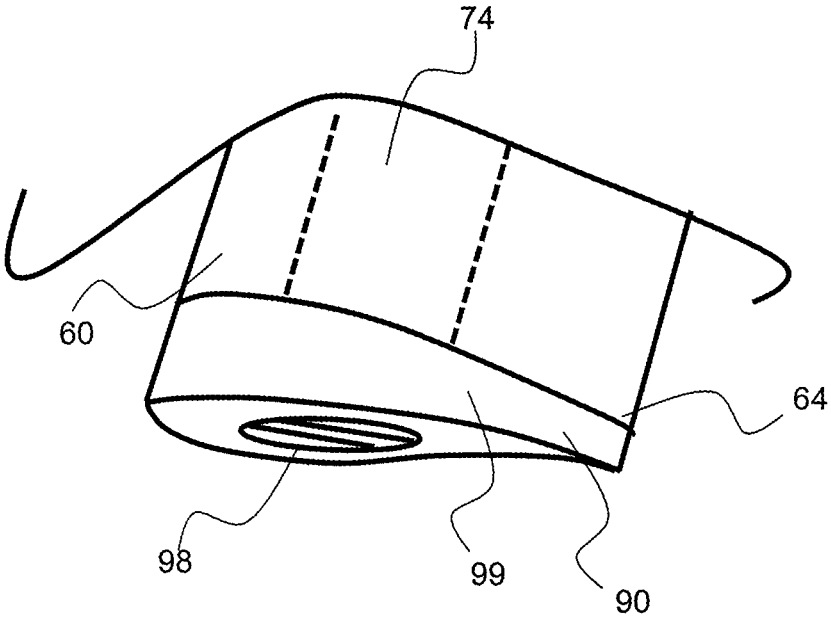
FIG. 7 shows an isometric view of an exemplary venturi feature adapter attached to the extended end of a fan blade comprising a venturi opening.

As shown in FIG. 7, an exemplary venturi feature adapter 99 type venturi feature 90 is attached to the extended end 64 of a fan blade 60 and comprises a venturi opening 98. A venturi feature may have any suitable shape such as the shape of the fan blade, as shown in FIG. 7.

Figure 8:
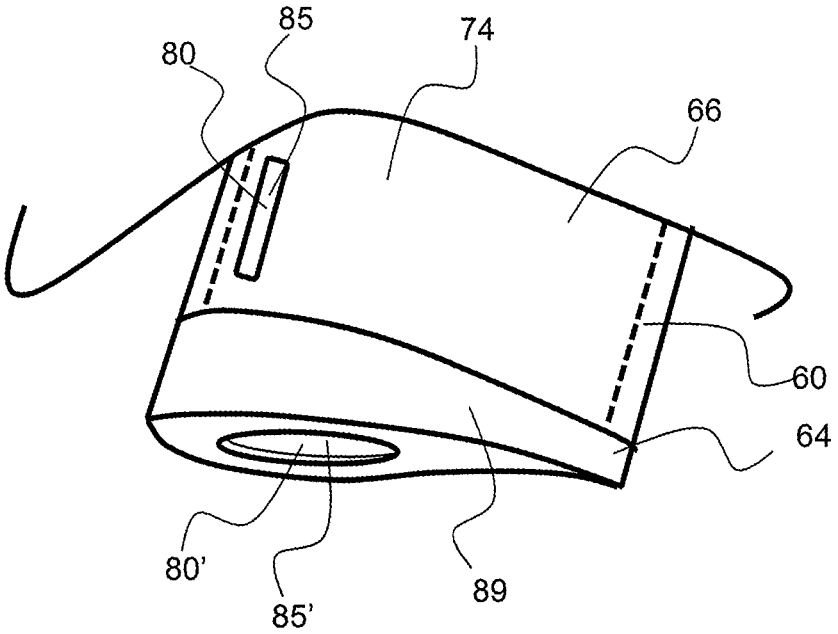
FIG. 8 shows an isometric view of exemplary vent features configured on the extended end of a fan blade.

As shown in FIG. 8, an exemplary vent feature 80 is configured along the top surface 66 of the extended end 64 of a fan blade 60. The extended end opening 85 couples with the conduit 74 that is configured with the fan blade. Air will be forced out of the vent feature 80 by centrifugal force when the fan blades rotate. A second vent feature 80' is shown being configured in a vent adapter 89 coupled to the extended end of the fan blade. An extended end opening 85' allows air to flow out of the end of the fan blade. The fan blade cap type of vent feature adapter may be configured to attach to the conduit 74 that extends within the fan blade.

Figure 9:
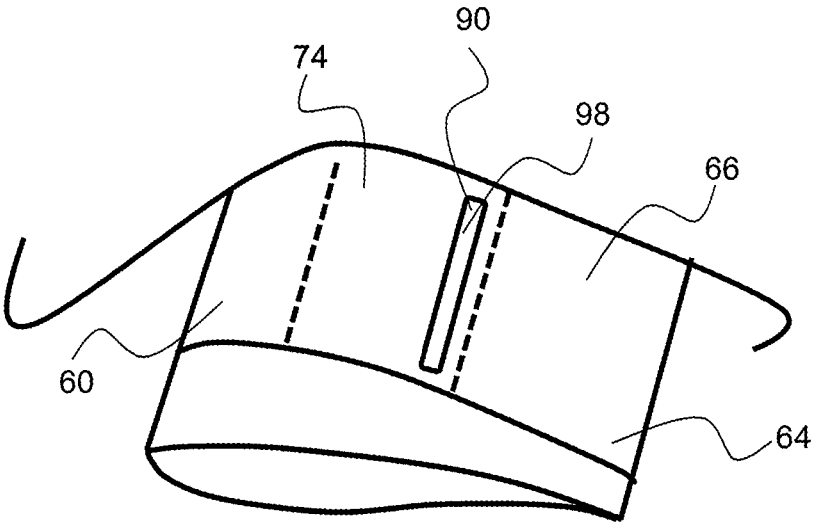
FIG. 9 shows an isometric view of an exemplary venturi feature configured on the top surface of the extended end of the fan blade.

As shown in FIG. 9, exemplary venturi feature 90 is configured on the top surface 66 of the extended end 64 of the fan blade 60. The venturi opening 98 is configured in a location along the top surface of the fan blade to create a vacuum within the conduit 74. A venturi adapter may be coupled to the fan to further increase the amount of vacuum produced in the conduit. In addition, a fan blade surface may be configured with any suitable geometric features to increase the vacuum produced by a venturi feature.

Figure 10:
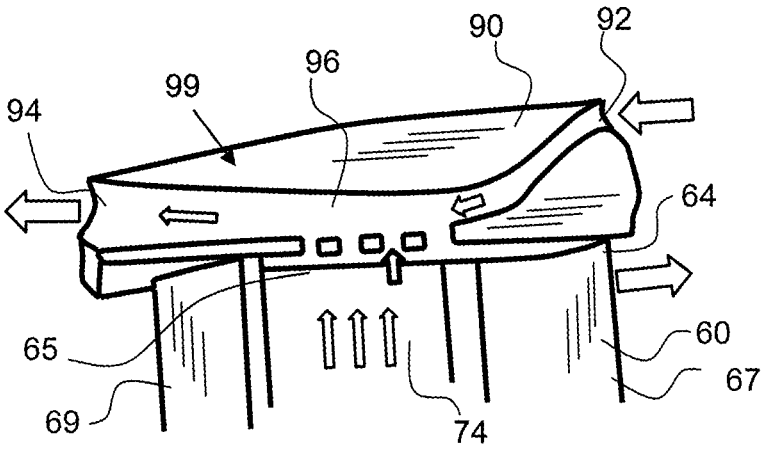
FIG. 10 shows a cut-away view of an exemplary venturi feature having a venturi channel.

As shown in FIG. 10, an exemplary venturi feature adapter 99 is coupled to the extended end 64 of a fan blade 60. The fan blade has a conduit 74 extending within the fan blade. The venturi feature 90 has a venturi channel 96 that extends from a leading edge 67 to the trailing edge 69 of the fan blade 60. This cross-section view of the venturi channel 96 shows that the cross-sectional area along the length of the channel changes. The cross-sectional area of the venturi feature 90 is reduced as it approaches the extended end opening 65 and then enlarges as it approaches the venturi channel outlet 94.

Figure 11:
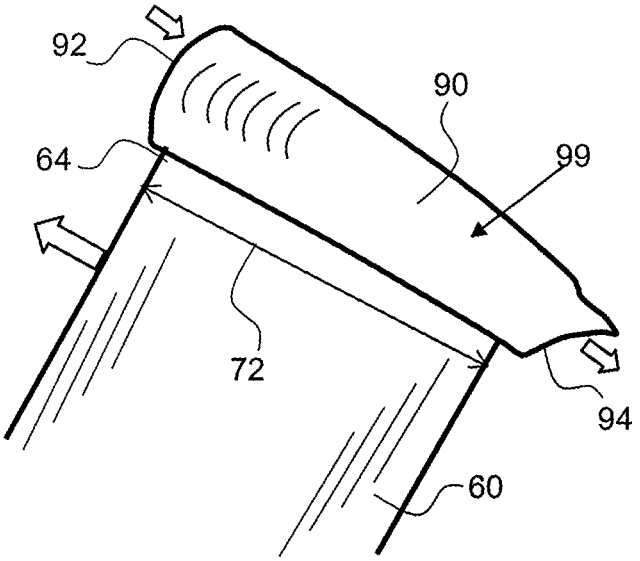
FIG. 11 shows a top-down view of an exemplary venturi feature.

As shown in FIG. 11, an exemplary venturi adapter 99 comprises a venturi channel inlet 92 and venturi channel outlet 94. The venturi channel extends along the width 72 of the fan blade 60.

Figure 12:
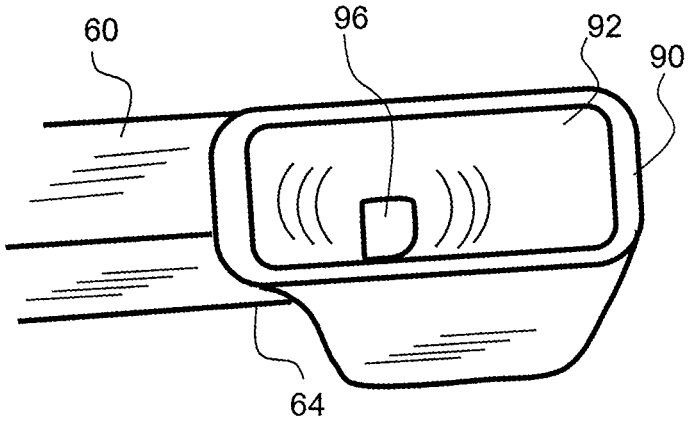
FIG. 12 shows an isometric view of an exemplary venturi feature having a venturi inlet and a venturi channel.

As shown in FIG. 12, an exemplary venturi feature 90 has a venturi inlet 92 and a venturi channel 96. The venturi features shown in FIG. 10 through FIG. 12 are asymmetric wherein the geometry is configured for rotation of the blades in one direction. A venturi channel could be designed to produce the venturi effect when the blade is rotated in either direction however.

Figure 13:
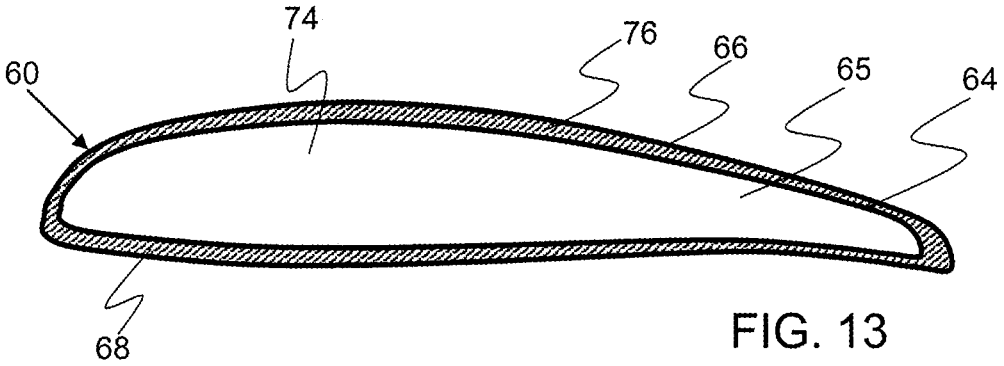
FIG. 13 shows a side view of the extended end of an exemplary hollow fan blade.

As shown in FIG. 13, an exemplary hollow fan blade 76 has an airfoil shape, with a curved top surface 66 that is longer than the bottom surface 68. An airfoil shaped fan blade may be utilized to provide efficient airflow from the fan. The hollow portion of the fan blade 60 is the conduit 74 for the flow of air through the fan blade. In HVLS applications, it may be preferable to utilize hollow fan blades to reduce the weight and power to turn the blades.

Figure 14:
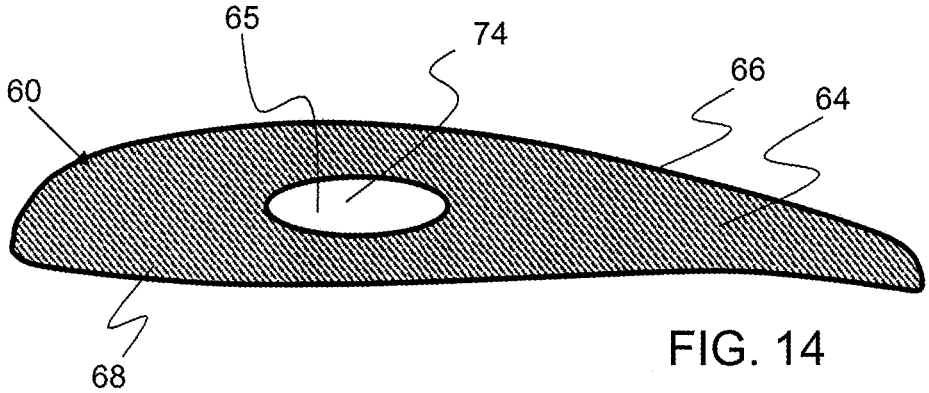
FIG. 14 shows a side view of the extended end of an exemplary fan blade having a conduit configured therein.

As shown in FIG. 14, the extended end 64 of an exemplary fan blade 60 has a conduit 74 configured therein. A fan blade may have any number of conduits configured within the fan blade. The extended end opening 65 may be the same size as the conduit that extends along the length of the fan blade or may be different in size. For example, the extended end opening may be smaller, or comprise a plurality of small openings to enhance the venturi effect.

Figure 15:
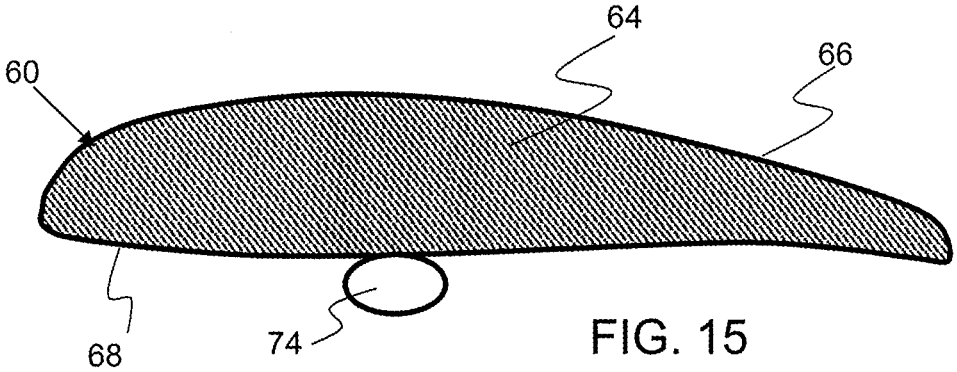
FIG. 15 shows a side view of the extended end of an exemplary fan blade having a conduit attached thereto.

As shown in FIG. 15, the extended end 64 of an exemplary fan blade 60 has a conduit 74 attached to the bottom surface 68 of the fan blade. A conduit coupled to the exterior of a fan blade may extend into a cooling zone within a fan housing.

Figure 16:
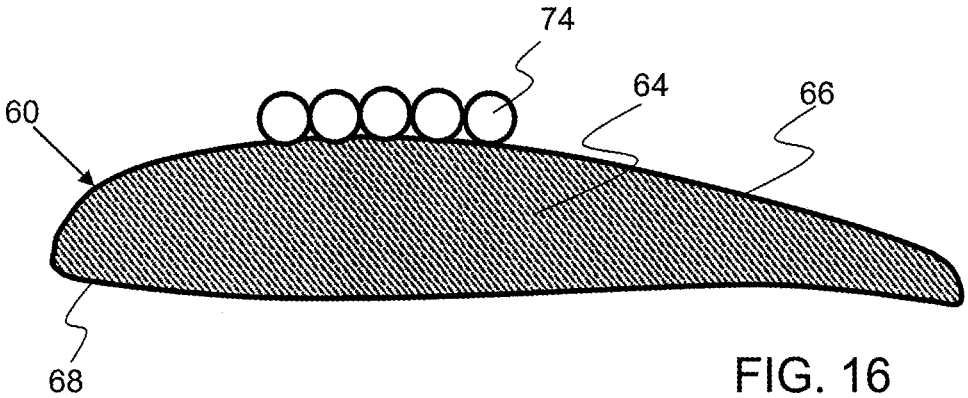
FIG. 16 shows a side view of the extended end of an exemplary fan blade having a plurality of conduits attached thereto.

As shown in FIG. 16, the extended end 64 of an exemplary fan blade 60 has a plurality of conduits 74 attached to the top surface 66 of the fan blade. Any number of conduits may be configured in or attached to a fan blade.

Figure 17:
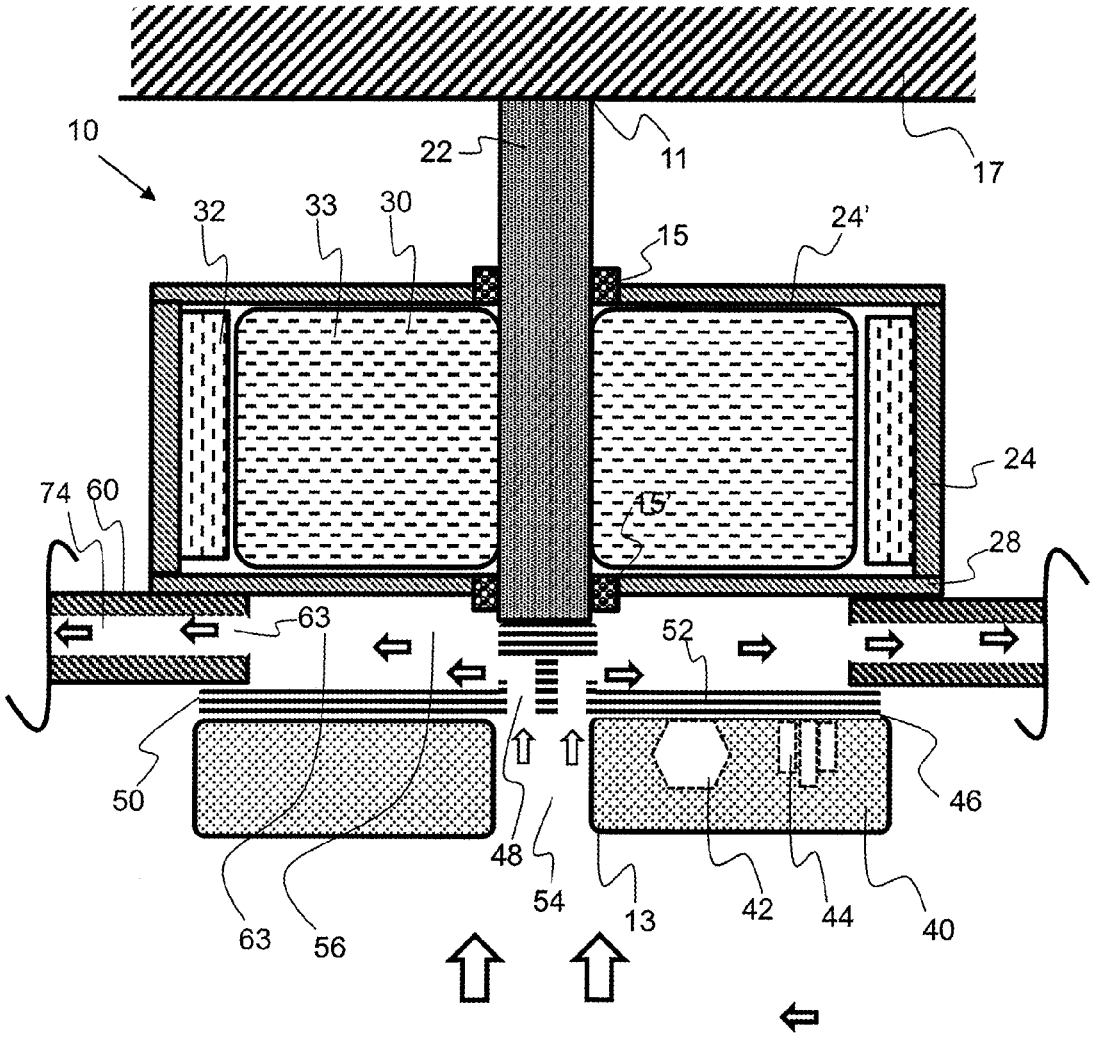
FIG. 17 shows a cross-sectional view of an exemplary self-cooling fan assembly having a heat sink coupled to the shaft and a control unit coupled to the heat sink.
Figure 18:
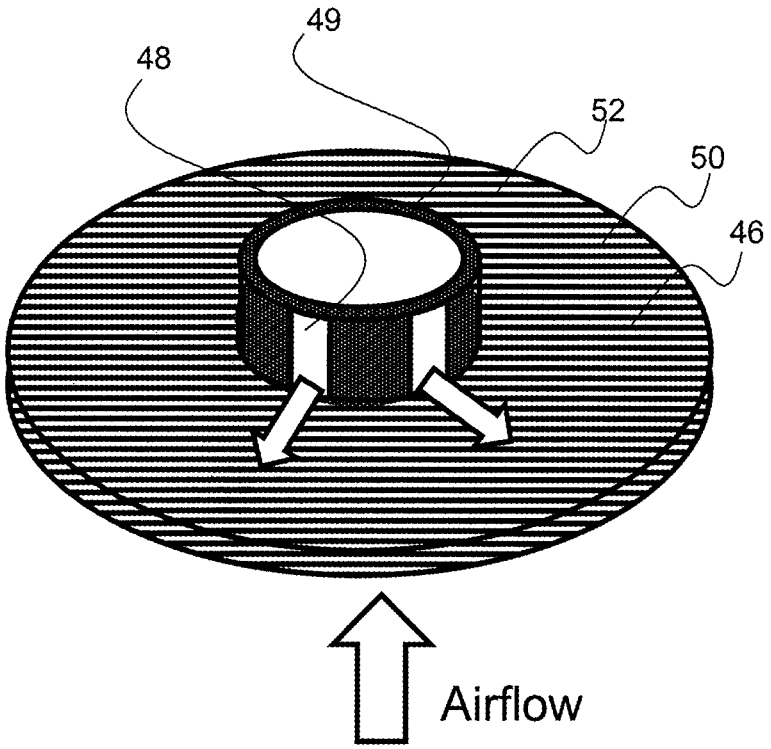
FIG. 18 shows an isometric view of an exemplary heat sink having openings for cooling airflow.

As shown in FIG. 17, an exemplary self-cooling fan assembly 10 has a heat sink 50 coupled to the shaft 22. A control unit 40 is coupled to the heat sink at the free end 13 of the fan assembly. The heat sink 50, as shown in more detail in FIG. 18, is attached to the shaft and the control unit is attached to the heat sink. Therefore, the heat sink 50 is a control unit mount 46 and has openings 48 for the flow of air therethrough. A cooling stream of air is drawn up through the cooling channel 54 that extends up through the control unit and through the heat sink 50. The air then flows through openings 48 in the heat sink and along the fins 52 and into the attached end opening 63 of the fan blade 60. The air then flows through the conduit 74 to the extended end of the fan blade where a vent feature is located. The power supply 42 and control electronics 44 are configured on the surface of the control unit 40 proximate the heat sink 50 to more effectively dissipate heat. A convective heat transfer occurs in the cooling zone 56 from the heat sink to the airflow. The airflow is tangential or parallel with the fins 52 and flows radially out from the center of the fan assembly or shaft 22. The airflow may be configured to flow through a portion of a heat sink, such as through fins or channels configured therein, or spirally within the cooling zone and/or through a portion of a heat sink. The cooling channel 54 is in direct fluid communication with air outside of the fan housing, whereby air directly outside of the fan housing, or within the same space as the fan assembly, is drawn into the cooling channel.

As shown in FIG. 18, an exemplary heat sink 50 is configured to be a control unit mount 46 and has openings 48 configured therein for cooling airflow. The heat sink shown may be attached to the fan assembly in any suitable way. As shown in FIG. 18, the heat sink may have an opening for coupling to the shaft, whereby the heat sink can be slid over the end of the shaft and secured thereto. Fins 52 are configured in a planar portion of the heat sink, as shown. Note that the collar 49 may be made out of any suitable material and may be made out of a different material than the fins 52. The collar may be a metal collar and the heat sink fins 52 may be coupled to the collar. This heat sink is configured for air to flow up through a portion of the collar, out the openings 48 and along the fins 52, as indicated by the arrows.

Figure 19:
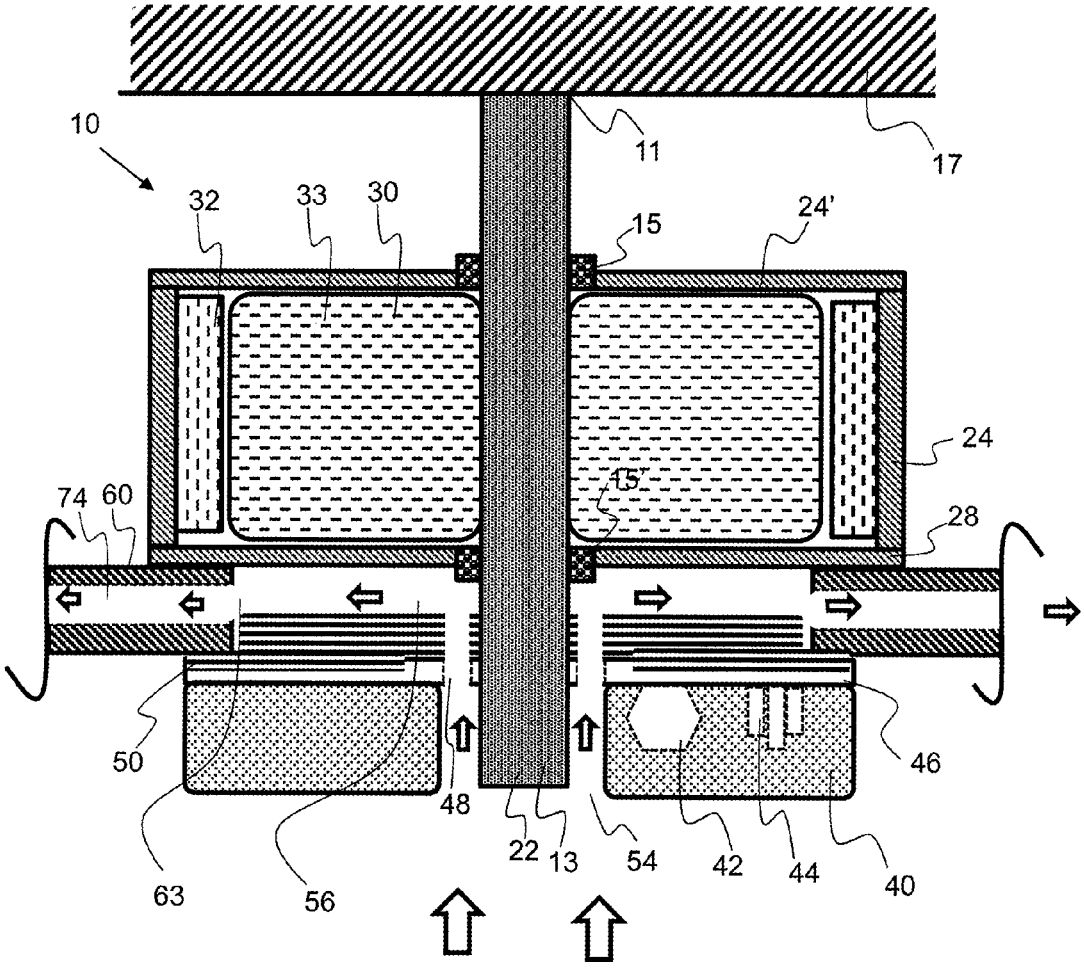
FIG. 19 shows a cross-sectional view of an exemplary self-cooling fan assembly having a heat sink coupled to a control unit.

As shown in FIG. 19, an exemplary self-cooling fan assembly 10 has a heat sink 50 coupled to a control unit 40. The heat sink is attached to the control unit mount 46 and extends up into a cooling zone 56, or open space between the cooling channel 54 and the attached end openings 63 of the fan blades 60. The control unit 40, configured below the motor 30, is attached to the shaft 22 and does not rotate. Air flows up from the free end 13 of the fan assembly, through the cooling channel 54, into the cooling zone 56, across the heat sink 50, into the attached end opening 63 of the fan blades 60 and along the conduit 74 configured within the fan blades, as indicated by the bold arrows. The control unit mount may be integral with the heat sink, in that it is a single piece of material or the two components may be attached. The motor 30 comprises a stator 33 that is attached to the shaft 22 and does not rotate with the fan blades. The rotor 32 is attached to the motor cover. The blade mount 28 couples the blades to the rotor. The rotor rotates and thereby rotates the blade mount and the blades. Bearings 15, 15' are configured to allow the motor cover to spin freely about the shaft. The control unit comprises a power supply 42 and control electronics 44. Heat is generated within the control unit and dissipation of this heat ensures proper functioning of the fan assembly.

Figure 20:
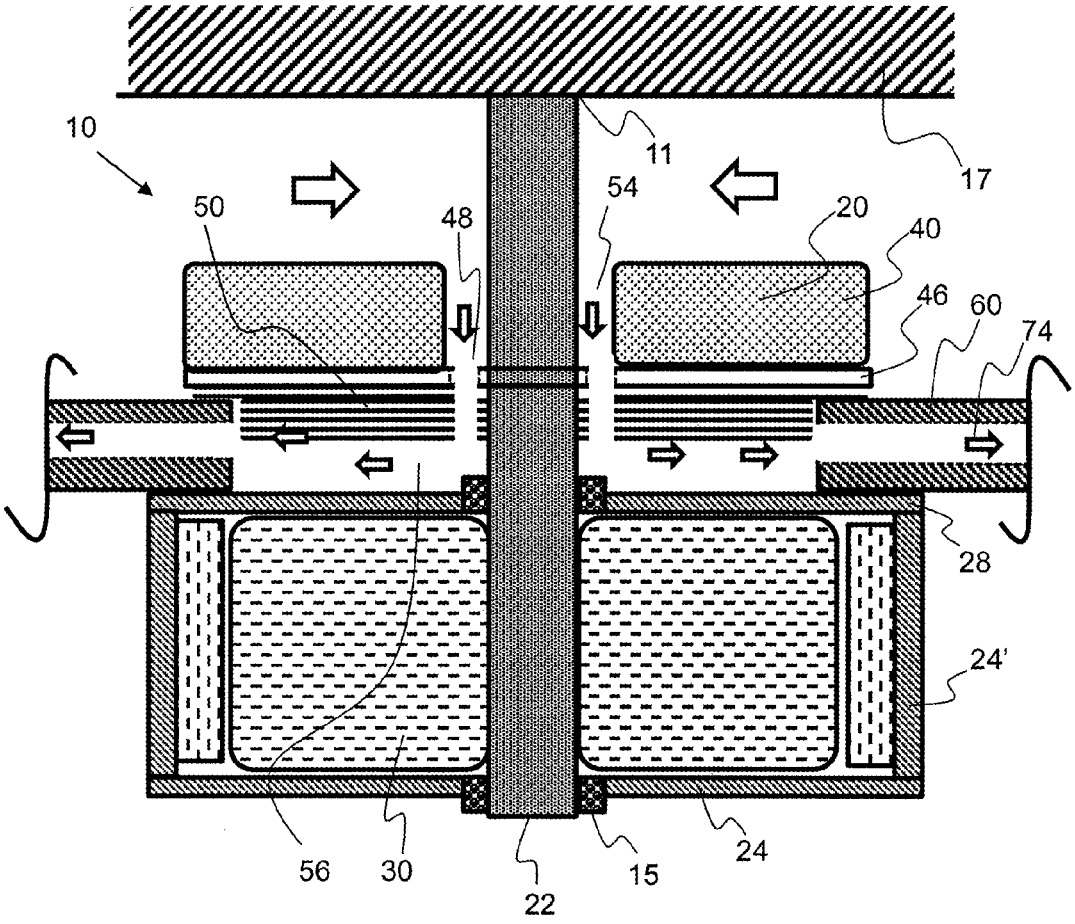
FIG. 20 shows a cross-sectional view of an exemplary self-cooling fan assembly having a heat sink coupled to a control unit and the control unit configured above the motor and fan blades.

As shown in FIG. 20, an exemplary self-cooling fan assembly 10 has a heat sink 50 coupled to a control unit 40 and the control unit is configured above the motor 30 and fan blades 60. In this embodiment, air is drawn in from the mount end 11 of the fan assembly, or an area above the fan housing 20 and down into the cooling channel 54. A heat sink 50 is configured within the cooling zone 56, where air flows through and over the heat sink. The cooling zone may be substantially sealed to allow airflow therein from the cooling channel only.

Figure 21:
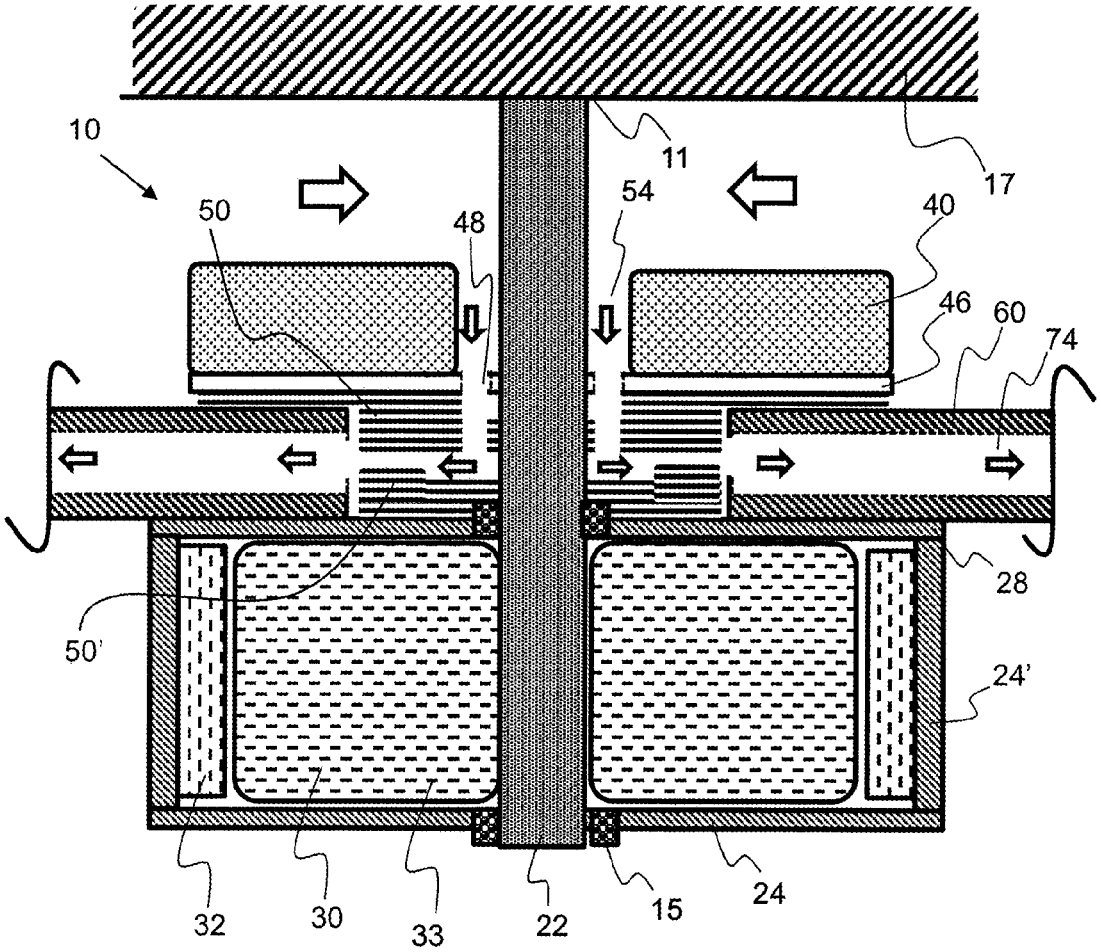
FIG. 21 shows a cross-sectional view of an exemplary self-cooling fan assembly having a heat sink coupled to a control unit and a heat sink coupled to a motor.

As shown in FIG. 21, an exemplary self-cooling fan assembly 10 has a heat sink 50 coupled to a control unit 40 and a heat sink 50' coupled to a motor 30. In this embodiment, air flows through the cooling channel, to the cooling zone, where the air flow dissipates heat from both the motor and the control unit. The motor heat sink 50' is attached to the motor cover 24 or housing that rotates with the blades. The motor heat sink 50' will therefore also rotate when the fan blades are rotating. In some embodiments, a control unit may be attached to, or may be part of motor unit. A control unit may be within a motor housing for example.

Figure 22:
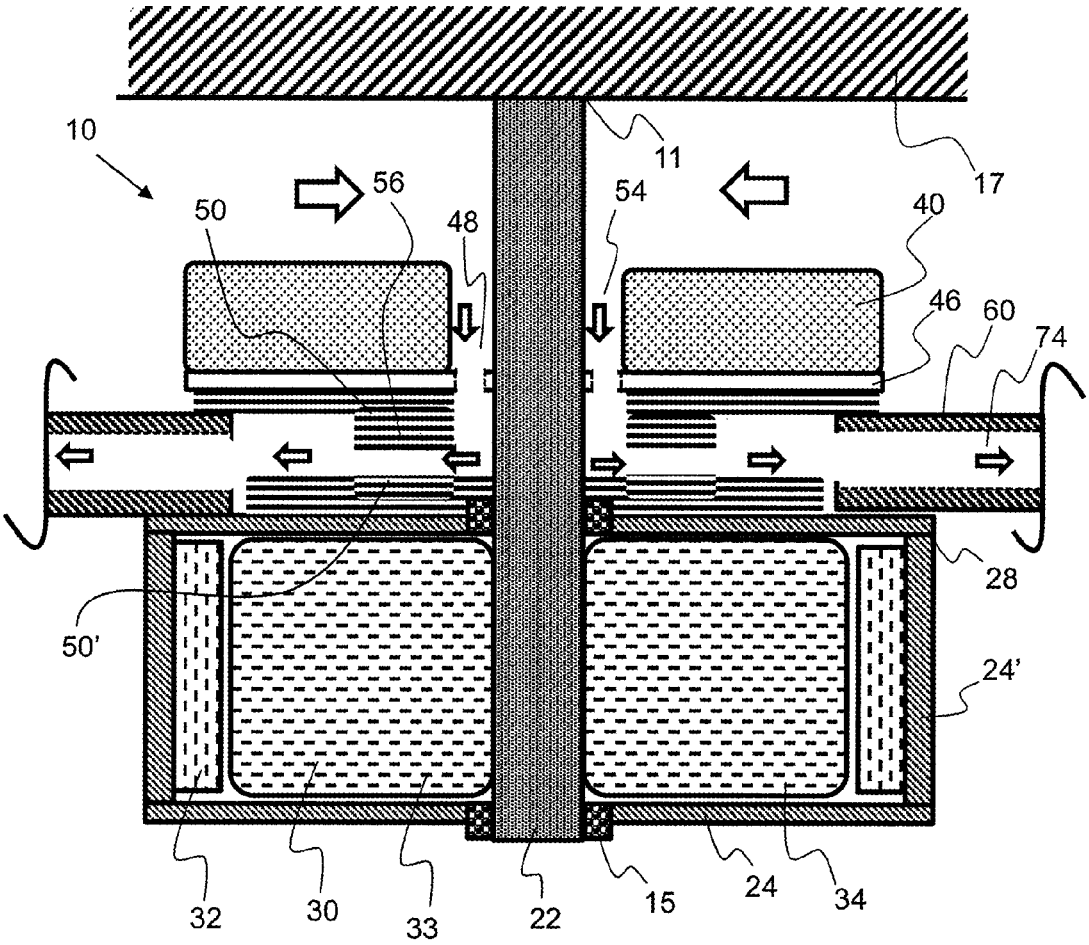
FIG. 22 shows a cross-sectional view of an exemplary self-cooling fan assembly having a heat sink coupled to a transverse flux motor and a control unit.

As shown in FIG. 22, an exemplary self-cooling fan assembly 10 has a heat sink 50 coupled to a transverse flux motor 34. The transverse flux motor has a stator 33 attached to a shaft 22, and a rotor attached to motor cover 24 that is configured to rotate. A heat sink 50 is configured within a cooling zone 56 and air drawn in through the cooling channel 54 flows over the heat sink to cool the motor. The cooling channel is configured between the shaft and the control unit 40.

Figure 23:
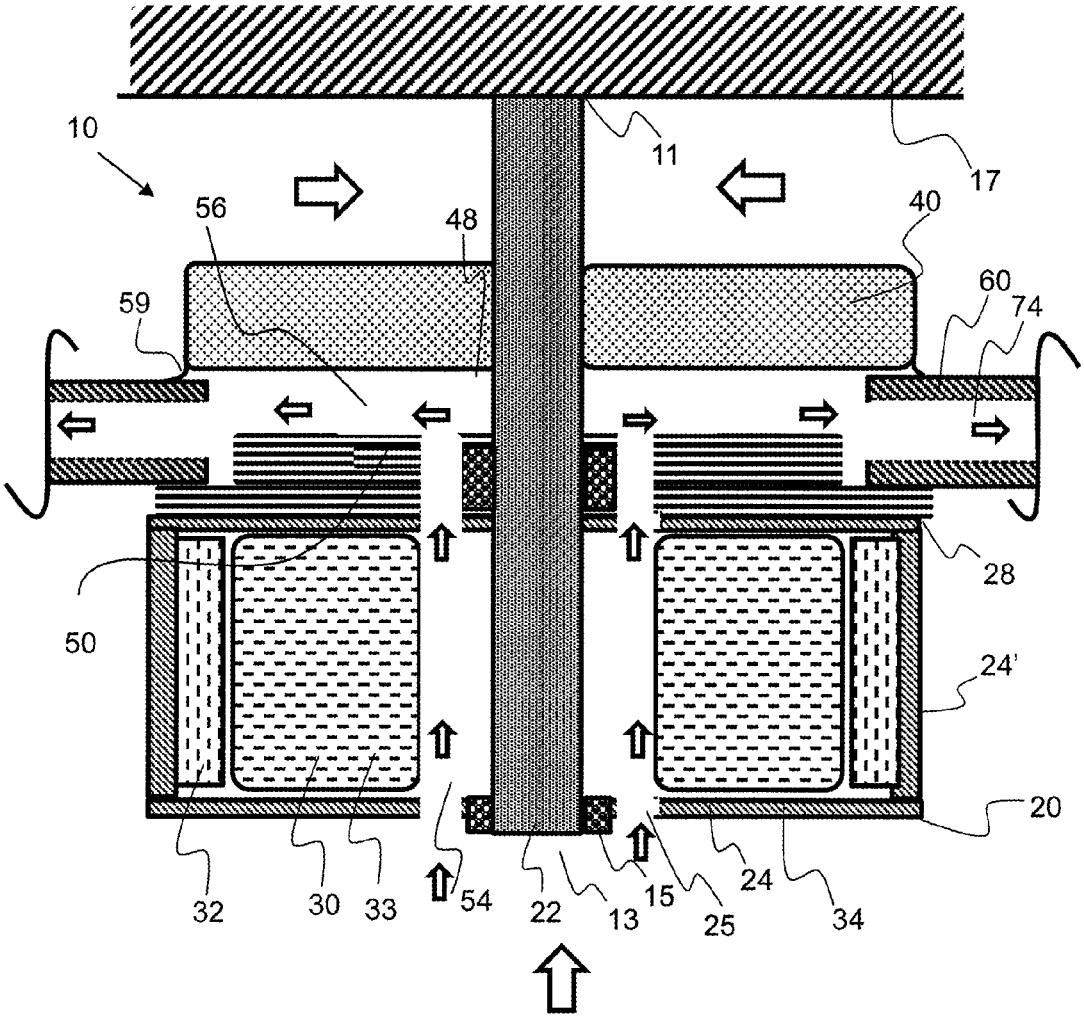
FIG. 23 shows a cross-sectional view of an exemplary self-cooling fan assembly having a heat sink coupled to a transverse flux motor.

As shown in FIG. 23, an exemplary self-cooling fan assembly 10 has a heat sink 50 coupled to a transverse flux motor 34. The cooling channel is configured between the shaft 22 and the motor 30. The motor cover 24 comprises openings 25 to allow air to flow up into the fan housing 20 from the free end 13. Air flows up the cooling channel and into the cooling zone 56 where the heat sink rotates as the air flows there over. A seal 59 is shown extending from the control unit to reduce airflow into the cooling zone 56 from outside of the fan housing. In an exemplary embodiment, essentially all of the airflow into the cooling zone is through the cooling channel 54. In addition, in an exemplary embodiment the cooling channel extends from the cooling zone to an immediate space around the fan housing that is directly outside of the fan housing. All of the cooling air is drawn from the space, or room, in which the fan assembly is mounted.

EXAMPLES

A hollow fan blade, similar to that shown in FIG. 13, available from Macro Air, San Bernadino, Calif. Airvolution with 16 foot blades, model number MA16XL1006, was fitted with a venturi tip as generally shown in FIG. 5. Air was forced over the extended end of the blade by the rotation of the blades. With the blades rotating at 70 RPM and the blade tips covered with an end cap, the air flow near the root of the blade or attached end, was measured through a 1 inch diameter circular opening with an anemometer and was approximately 4 mph. With the venturi tip, as generally shown in FIG. 5, attached to the end of the blade tips, the air flow was again measured through this 1 in diameter opening while the blades rotated at 70 RPM, and was approximately 20 mph. The venturi tip effectively produced a flow of air through the fan blade conduit.

DEFINITIONS

A fan housing, as used herein, is a cover that contains a motor and/or control unit. A self-cooling fan assembly may have a single fan housing or a separate fan housing for the motor and control unit.

A self-cooling fan, as used herein, is a fan that generates a convective airflow through the fan housing for the purpose of cooling the fan motor and/or control unit.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A self-cooling ceiling fan assembly comprising:

a. a fan housing;

b. at least one cooling channel;

c. a shaft;

d. a motor;

e. a plurality of air foil shaped fan blades wherein each fan blade comprises:

i. a length;

ii. an attached end;

iii. an extended end;

f. a vent feature comprising one of more openings in the extended end of at least one of said plurality of fan blades; and g. a conduit extending from said attached end, along the length of said at least one of said plurality of fan blades to said vent feature and having a conduit opening that opens into the vent feature;

whereby when said plurality of fan blades rotate, air flows through said at least one cooling channel, through said fan housing, through said conduit, through said conduit opening and into the vent feature and out of said vent feature to provide a self-cooling fan assembly; and wherein the air flows through the cooling channel into a cooling zone to cool said motor and/or a control unit.

2. The self-cooling ceiling fan of claim 1, wherein the conduit extends within at least one of the plurality of fan blades.

3. The self-cooling ceiling fan assembly of claim 1, wherein the cooling channel extends from the exterior of the fan housing to the cooling zone, whereby when the plurality of fan blades rotate, air flows from an area immediately outside of the fan housing into the cooling channel, into the cooling zone, through and out of said vent feature.

4. The self-cooling ceiling fan assembly of claim 3, comprising a heat sink configured within the cooling zone, whereby air flows over the heat sink when the plurality of fan blades rotate.

5. The self-cooling ceiling fan assembly of claim 4, wherein the heat sink is operably coupled to the motor.

6. The self-cooling ceiling fan assembly of claim 4, wherein the heat sink is operably coupled to said control unit.

7. The self-cooling ceiling fan assembly of claim 6, wherein the control unit is configured proximate a free end of said fan assembly and the heat sink is configured between said control unit and the motor.

8. The self-cooling ceiling fan assembly of claim 4, wherein a first heat sink is coupled to said control unit and a second heat sink is coupled to the motor.

9. The self-cooling ceiling fan assembly of claim 4, wherein the heat sink comprises a plurality of fins that extend radially from the shaft.

10. The self-cooling ceiling fan assembly of claim 1, wherein the plurality of fan blades are hollow fan blades and the conduit is formed by at least one of said hollow fan blades.

11. The self-cooling ceiling fan assembly of claim 1, wherein the self-cooling fan assembly is a high volume low speed fan having a diameter of no less than 8 feet.

12. The self-cooling ceiling fan assembly of claim 1, wherein the motor is a transverse flux motor.

13. The self-cooling ceiling fan assembly of claim 1, wherein the vent feature comprises a venturi feature.

14. The self-cooling ceiling fan assembly of claim 13, wherein the venturi feature consists essentially of one or more venturi openings in at least one of the extended ends of the plurality of fan blades.

15. The self-cooling ceiling fan assembly of claim 13, wherein the venturi feature comprises a venturi adapter that is coupled to the extended end of at least one of said plurality of fan blades.

16. The self-cooling ceiling fan assembly of claim 13, wherein the venturi feature comprises a venturi flow channel comprising:

a. venturi inlet;

b. a venturi outlet; and c. a length from said venturi inlet to said venturi outlet, wherein the conduit opening of the conduit opens into the venture channel;

whereby said venturi flow channel has a change in a cross-sectional area along said length of said venturi flow channel.

17. The self-cooling ceiling fan assembly of claim 1, wherein the vent feature is a direction neutral vent feature, whereby air flows out from said conduit with the plurality of fan blades moving in a first or in an opposing second direction.

18. The self-cooling ceiling fan assembly of claim 1, wherein the cooling channel is an open space between the shaft and the motor.

19. The self-cooling ceiling fan assembly of claim 1, wherein the cooling channel is an open space between the shaft and a control unit.

20. The self-cooling ceiling fan assembly of claim 1, wherein the fan blades are coupled to a fan mount, and wherein the fan mount is coupled to a rotor that is configured around a fixed stator.

21. The self-cooling ceiling fan assembly of claim 20, wherein the motor is a transverse flux motor.

22. A self-cooling ceiling fan assembly comprising:

a. a fan housing;

b. a shaft;

c. a motor, d. a control unit;

e. a cooling channel;

f. a cooling zone;

g. a plurality of air foil shaped fan blades wherein each fan blade comprises:
   i. a length;
   ii. an attached end; and
   iii. an extended end;

h. a vent feature coupled to the extended end of least one of said plurality of fan blades; and i. a conduit extending within at least one of said plurality of fan blades from the attached end along the length of the fan blade to the vent feature;

wherein the conduit has a conduit opening that opens into said vent feature;

whereby when the plurality of fan blades rotate, the vent feature draws air into the cooling zone from the cooling channel, through an opening in the attached end of at least one of said plurality of fan blades, through said conduit, through said conduit opening and into the vent feature and out of said vent feature.

23. The self-cooling ceiling fan assembly of claim 22, wherein the fan blades are coupled to a fan mount, and wherein the fan mount is coupled to a rotor that is configured around a fixed stator and the motor is a transverse flux motor.

* * * * *